United States Patent [19]

Riley

[11] 4,186,361

[45] Jan. 29, 1980

[54] FLUID (LIQUID OR GAS) OR ELECTRICALLY CONTROLLED MULTIPURPOSE SWITCH

[76] Inventor: Leon H. Riley, 7707 Logan Dr. SW., Huntsville, Ala. 35802

[21] Appl. No.: 897,615

[22] Filed: Apr. 19, 1978

[51] Int. Cl.[2] ..... H01H 9/00; H01H 57/00; H01H 59/00

[52] U.S. Cl. ..... 335/179; 200/81.9 R; 200/181; 335/82

[58] Field of Search ..... 335/79, 80, 81, 82, 335/177, 178, 179, 180, 181, 182, 183; 361/210; 200/81.4, 81.9 R, 81.9 M, 181

[56] References Cited

U.S. PATENT DOCUMENTS

| | | | |
|---|---|---|---|
| 2,456,256 | 12/1948 | Crowley | 361/210 X |
| 2,611,051 | 9/1952 | Kolff | 200/81.9 M X |
| 2,635,155 | 4/1953 | Barr | 335/179 X |
| 2,902,685 | 9/1959 | Davis | 200/81.9 R X |
| 3,115,562 | 12/1963 | Robinson | 335/179 X |

*Primary Examiner*—Fred L. Braun

*Attorney, Agent, or Firm*—Nathan Edelberg; Robert P. Gibson; Robert C. Sims

[57] ABSTRACT

The switch is mounted on a cantilever spring which has a contact that can be positioned over and engage individual contacts of a large bank of contacts. A device is mounted on the spring so as to be responsive to forces either electrostatic, magnetic, gas or liquid pressure. These forces selectively select one of the contacts of the bank of contacts.

6 Claims, 4 Drawing Figures

FLUID (LIQUID OR GAS) OR ELECTRICALLY CONTROLLED MULTIPURPOSE SWITCH

DEDICATORY CLAUSE

The invention described herein may be manufactured, used, and licensed by or for the Government for governmental purposes without the payment to me of any royalties thereon.

DESCRIPTION OF THE PREFERRED EMBODIMENT

Present multiposition switches require many parts. Precision machining, alignment and assembly of these parts is required. This invention greatly reduces the number of parts and the mechanical precision required of parts. The invention is a simple assembly that is easily aligned. The invention's simplicity results from the use of an electrostatically or magnetically controlled cantilever spring to which is attached a floating contact. The floating contact can be randomly aligned with and engage any of a bank of stationary electrical contacts.

The invention has the following advantages over previous electrically controlled multiposition switches.

1. The small number of precision parts and the reduced mechanical alignment requirements reduce the cost of the switch. Mechanical precision required in previous switches is reduced to voltage or pressure settings that can be handled economically.

2. The random switching rate is faster than on previous switches. The floating contact is positioned over the desired contact by electrostatic, magnetic, gas or fluid pressures.

3. Computer control of the floating contacts can be easily provided for convenient positioning and engagement of the floating contact with a bank of randomly accessible contacts.

4. The random accessibility of the floating contact to a bank of contacts is unique to this switch and not provided by present switches.

5. This switch will provide for the transmission of higher frequencies than other type multiposition switches. Coaxial contacts can be built into the floating contact to engage with similar coaxial contacts built into each of the bank of contacts.

The operation of the fluid (liquid or gas) or electrically controlled multiposition switch is described by sketches in FIGS. 1–4 and the following discussion.

Figure 1:
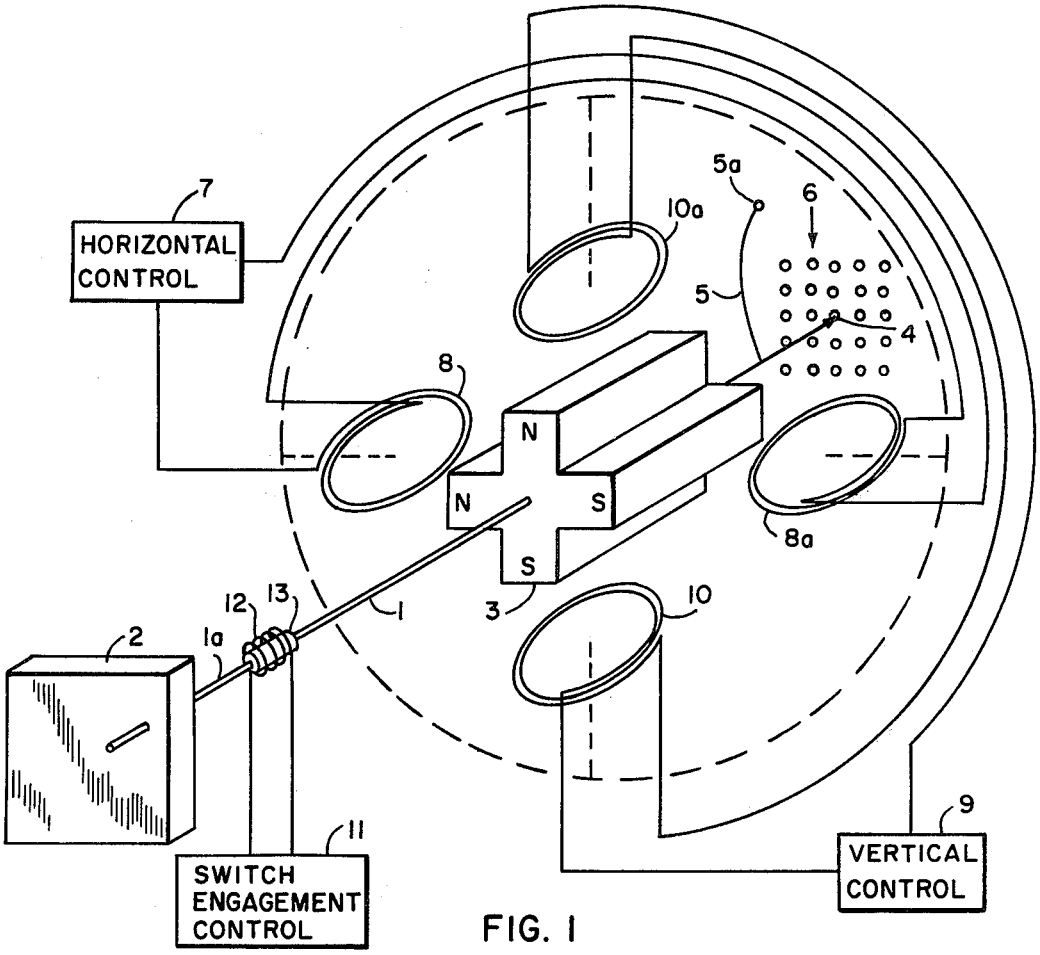
FIG. 1 is a diagrammatic representation of the present invention using magnetic or electrostatic driving means.

Referring to FIG. 1, a cantilever spring 1 is mounted in a fixed guide 2. Permanent magnets or electrostatically charged plates 3 are mounted on the spring. A floating electrical contact 4 is mounted to the spring, or the end of the spring may serve as the contact. The floating contact lead 5 is shown connected to an output terminal 5*a*. The bank of switch contacts 6 are maintained in a fixed spatial relationship to guide 2. The horizontal control 7 is shown connected to the field coils or plates 8 and 8*a* it controls. The vertical control 9 is connected to coils or plates 10 and 10*a*. The switch engagement control 11 is shown with the coil or plate 12 it controls.

Operation of the device is as follows: the fixed guide 2 holds the spring 1 with its floating contact 4 and magnet or electrostatically charged plates 3 in a reference position. Voltage is applied to the horizontal 7 and vertical 9 controls which align the floating contact 4 with the desired contact of the bank of contacts 6. This alignment is caused by magnetic or electric force of the coils or plates 8, 10 on the magnet or plates 3. The switch engagement 11 is actuated causing the permanent magnet or electrostatic tube 13 to move elements 1, 3 and 4 to the right due to the force of the winding or plate 12. This causes the floating contact 4 to engage the desired contact or bank contact 6. Electrical connection is now provided from terminal 5*a* to the desired circuit. To break this connection switch engagement control 11 is released or reversed resulting in the disengagement of the floating contact 4 from the bank contact 6. The floating contact may be aligned with and engage any of the bank of contacts by horizontal and vertical field control and switch engagement control. Several switches may be controlled in parallel through single horizontal, single vertical and single switch engagement voltage controls.

Figure 4:
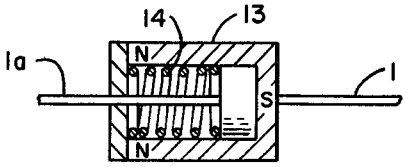
FIG. 4 is a showing in cross-section of the engagement control device.

Tube 13 can be moveably connected to guide 2 by rod 1*a* which has one end inside tube 13. FIG. 4 shows rod 1*a* inserted into tube 13 so as to have two stops. A spring 14 can be used to bias the system to an open position.

The fluid controlled multiposition switch operates similar to the electrically operated switch described above. A switch can be a hybrid. For instance switch may utilize magnetic probe alignment and fluid switch engagement control.

Figure 2:
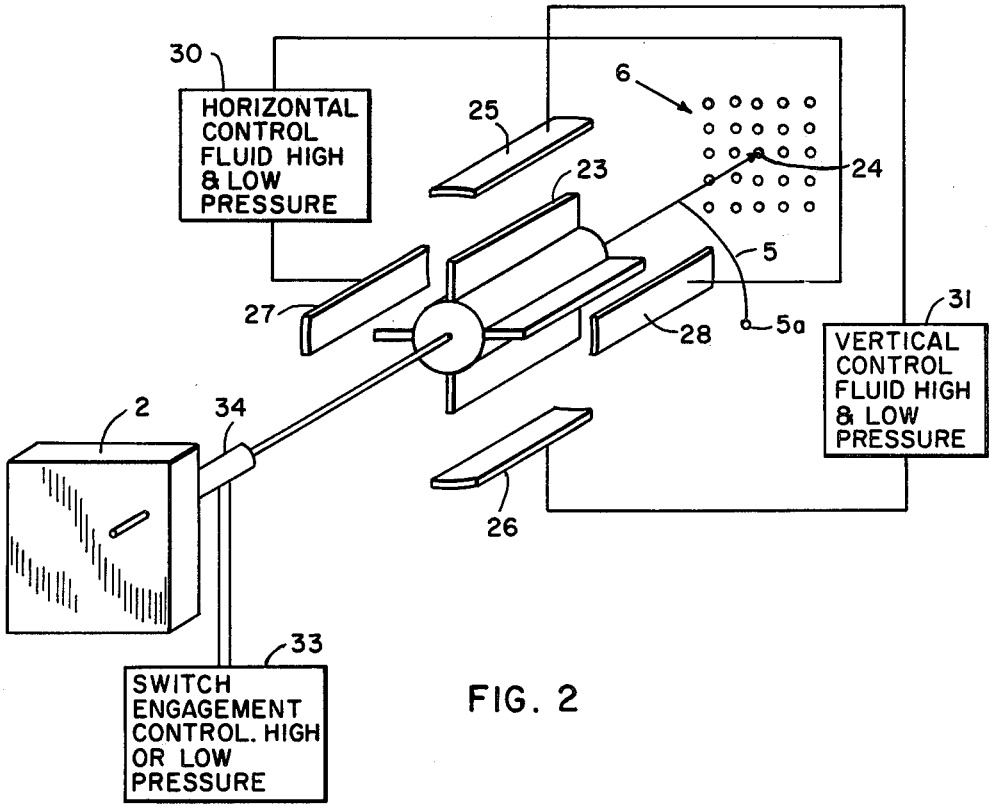
FIG. 2 is a diagrammatic representation of the present invention showing the use of fluid pressure forces.

Referring to FIG. 2 the fluid switch has a floating contact 24 and fluid vane 23 mounted on guide 2. Floating contact 24 position control is provided by vertical 25 and 26 and horizontal 27 and 28 forces applied to the vane 23. This is controlled by pressure regulation at horizontal 30 and vertical 31 controls. By these controls the floating vane is positioned over a selected contact of bank contact 6. Engagement is by switch control 33 and piston actuator 34. The floating contact 24 may be disengaged and repositioned and engaged with any of the bank of contacts by switch 33, vertical 31 and horizontal 30 controls.

Figure 3:
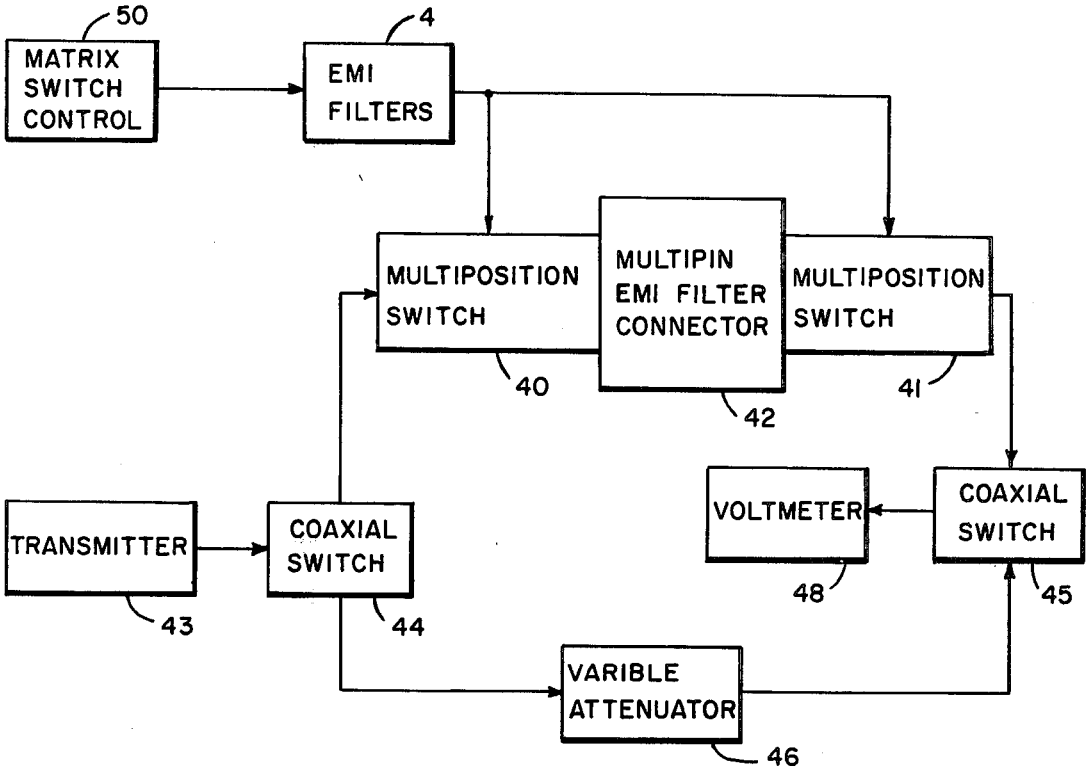
FIG. 3 is a block diagram showing a test setup using the present invention.

An example of utilization of two of these switches 40 and 41 is shown in FIG. 3. Attenuation measurements are made separately of each pin of a multipin EMI filter connector 42. The standard attenuation measurement technique is shown. Electromagnetic energy from transmitter 43 is passed through the test item 42 and a voltage reading is made. The energy is then transferred through coaxial switches 44 and 45 through attenuator 46 that is adjusted until an identical voltage reading is obtained on voltmeter 48. The attenuator reading is then the filter capability of the filter under the test conditions. Using the multiposition switches in conjunction with the multipin connector in these tests saves considerable time. Presently each EMI filter pin must be separately and manually connected for each measurement. The switch described in this invention automates this testing in that the outputs on matrix switch control 50 can be programed.

I claim:

1. A switching device comprising a plurality of terminals; a floating contact; responsive means connected to said floating contact; and control means located in a fixed spatial relationship to said terminals and in a spatial relationship to said responsive means so as to position said responsive means such that a select one of said plurality of terminals is engaged by said floating contact; wherein said responsive means are electrostatic plates; and said control means are electrostatic plates.

2. A switching device comprising a plurality of terminals; a floating contact; responsive means connected to said floating contact; control means located in a fixed spatial relationship to said terminals and in a spatial relationship to said responsive means so as to position said responsive means such that a select one of said plurality of terminals is engaged by said floating contact; a cantilever spring on which said floating contact and responsive means are mounted; a guide means located in a fixed spatial relationship to said control means; engagement means; said spring being mounted to said guide means by said engagement means; and said engagement means being adapted for movement of said spring and said floating contact so that said floating contact can be selectively moved such that it is either in contact with one of said plurality of terminals or is out of contact with all of said plurality of contacts.

3. A switching device as set forth in claim 2 wherein said responsive means is a permanent magnet means and said control means are coil means.

4. A switching device as set forth in claim 2 wherein said responsive means and said control means are electrostatic plates.

5. A switching device as set forth in claim 2 wherein said responsive means consists of a plurality of fluid vanes and said control means are a plurality of fluid pressure generating devices.

6. A system as set forth in claim 5 wherein said engagement means is a piston actuator.

* * * * *